US006192977B1

(12) United States Patent
Dey et al.

(10) Patent No.: US 6,192,977 B1
(45) Date of Patent: Feb. 27, 2001

(54) TUBE FOR HEAT EXCHANGER

(75) Inventors: La Voyce Dey, Pennsylvania, PA (US); Laszlo Valaszkai, Sölvesborg (SE)

(73) Assignee: Valeo Thermique Moteur, la Verriere (FR)

( * ) Notice: Subject to any disclaimer, the term of this patent is extended or adjusted under 35 U.S.C. 154(b) by 0 days.

(21) Appl. No.: 09/409,019

(22) Filed: Sep. 29, 1999

(51) Int. Cl.[7] ..... F28F 1/00

(52) U.S. Cl. ..... 165/177; 29/890.049; 29/890.053; 29/890.054; 138/168

(58) Field of Search ..... 165/152, 153, 165/177, 178; 29/890.043, 890.053; 138/168

(56) References Cited

U.S. PATENT DOCUMENTS 824,492 * 6/1906 Livingston ..... 165/153
2,912,749 * 11/1959 Bauernfeind et al. ..... 165/153
3,053,511 * 9/1962 Godfrey ..... 29/890.053
4,470,452 * 9/1984 Rhodes ..... 165/153
4,570,700 * 2/1986 Ohara et al. ..... 165/134.1
5,185,925 * 2/1993 Ryan et al. ..... 29/890.053
5,439,050 * 8/1995 Waterman et al. ..... 165/170
5,441,105 * 8/1995 Brummett et al. ..... 165/153
5,692,300 * 12/1997 Conn et al. ..... 29/890.053
5,956,846 * 9/1999 Ross et al. ..... 29/890.043
6,014,988 * 1/2000 Gagnon et al. ..... 29/890.053

* cited by examiner

*Primary Examiner*—Ira S. Lazarus
*Assistant Examiner*—Terrell McKinnon
(74) *Attorney, Agent, or Firm*—Morgan & Finnegan, LLP

(57) ABSTRACT

A tube for a heat exchanger has a cross-section having two opposed side walls and two opposed ends. The ends have curved portions and one of the ends has a double wall comprising an inner wall and an outer wall. One of these side walls extends to form the outer wall and the other of the side walls extends to form the inner wall. Each of the outer and inner walls has a respective extremity, the inner wall being offset inwardly to accommodate the extremity of the outer wall and the extremity of the inner wall deviating away from the outer wall.

31 Claims, 2 Drawing Sheets

TUBE FOR HEAT EXCHANGER

FIELD OF THE INVENTION

The present invention relates to a tube for a heat exchanger and a process for manufacture of such a tube, and more specifically to a so-called "folded tube" of a type suitable for furnace brazing.

BACKGROUND OF THE INVENTION

U.S. Pat. No. 1,937,343 discloses a motor vehicle radiator having tubes of the folded type. The tubes of this prior art document have a seam at an end portion of the cross-section of the tube, the seam being formed by folding the two edge portions of the very thin metal of which the tube is constructed, each upon itself, followed by interlocking the folded portions flat against the inner surfaces of the tube wall.

The transverse curvature of the seam gives a good lock and assists in soldering the seam.

In prior art tubes, a close fit between the inner and outer edge portions of the seam will prevent adequate flux penetration for successful brazing of the inner portion of the seam. This is particularly true for so-called "NOCOLOK" (RTM) brazing. Where the fit is too tight, flux must be drawn in from the outside or from the open ends of the tube. Neither of these brazing methods is reliable.

It is accordingly an object of the present invention to provide an improved structure and an improved method of manufacture.

SUMMARY OF THE INVENTION

According to a first aspect of the present invention there is provided a method of forming a tube for a heat exchanger, said tube having a cross-section having two opposing ends and two opposing sides, one of said ends having a double wall, said method comprising: forming an inner wall of said double wall, said inner wall extending in one direction to an extremity region and in a second direction opposite to said one direction, to one of said opposing sides via a transition region;

forming an outer wall of said double wall, said outer wall extending from the other of said opposing sides to an extremity;

wherein said transition region accommodates said extremity of said outer wall and said extremity region of said inner wall is formed to deviate away from said outer wall.

Preferably said method further comprises causing flux to penetrate between said extremity region of said inner wall and said outer wall and between said extremity of said outer wall and said transition region.

Advantageously said method further comprises brazing said inner and outer walls together.

In an alternative embodiment of the invention, the brazing step may comprise NOCOLOK (RTM) brazing.

According to a second aspect of the present invention there is provided a tube for a heat exchanger having a cross-section comprising two opposed side walls and two opposed ends, said opposed ends comprising curved portions, the outer surface of said ends being substantially mirror symmetrical, one of said ends having a double wall comprising an inner wall and an outer wall, one of said side walls extending to form the outer wall and the other of said side walls extending to form the inner wall wherein each of said outer and said inner walls has a respective extremity, the inner wall, in a region overlaid by the extremity of the outer wall, being offset inwardly to accommodate said extremity of the outer wall, and the extremity of the inner wall deviating away from the outer wall.

Advantageously said tube further comprises brazed joints extending between portions of said inner and outer walls.

Advantageously said opposed ends each comprise a substantially planar portion whereby said tube is oblong in cross-section.

Conveniently said side walls are substantially parallel.

BRIEF DESCRIPTION OF THE DRAWINGS

Preferred embodiments of the present invention will now be described with reference to the accompanying drawings in which.

DESCRIPTION OF THE PREFERRED EMBODIMENTS

Figure 1:
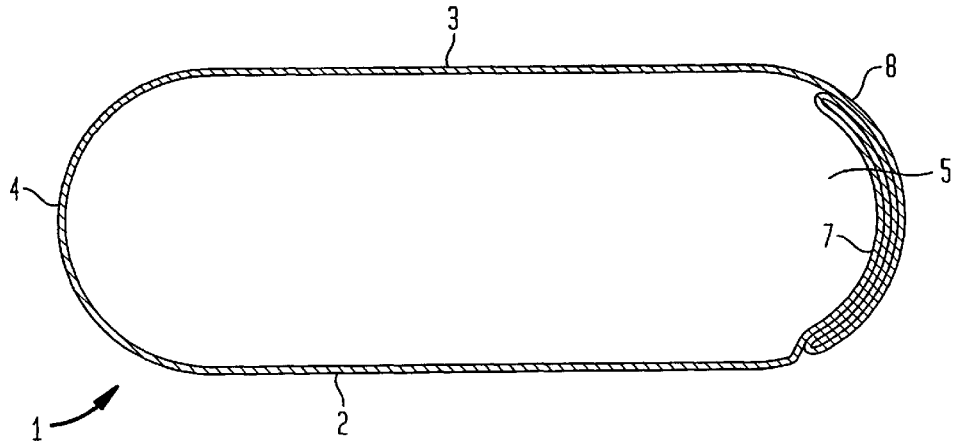
FIG. 1 shows a cross-section of a heat exchanger tube of the prior art.

In the figures like reference numerals refer to like parts.

Referring first to FIG. 1, a radiator tube 1 is formed from a single sheet of thin metal to have two opposed generally planar long side portions 2, 3 and two opposed end portions 4, 5.

A first end portion 5 of the cross-section of the tube is formed by folding together extension portions of the long side walls, such that one of the long side walls 2 extends to form an innermost wall 7 in the end region 5 and the opposing wall 3 extends to form an outermost wall 8 in the end region 5. The innermost wall 7 curves around substantially the whole of the end region 5 before doubling back on itself, again over substantially the whole of the end region 5. The outer wall 8 likewise extends substantially around the whole of the end region 5 before doubling back on itself to be disposed between the two runs of the innermost wall 7, so that there are four thicknesses of metal in the end region 5.

Figure 2:
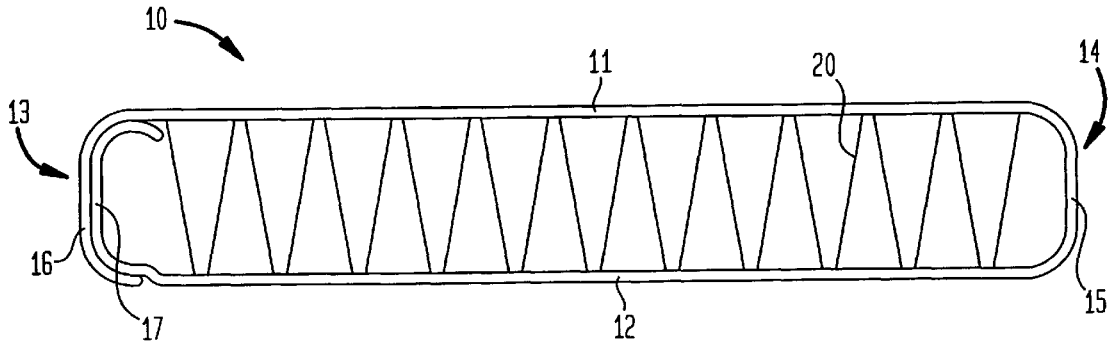
FIG. 2 shows a cross-sectional view of a first preferred embodiment of the present invention.

Referring now to FIG. 2 a radiator tube 10 is of generally oblong form having two substantially planar opposed long walls 11, 12 and two end portions 13, 14 the end portions in this case comprise planar portions 15, 16 extending via curves into the long opposing long walls 11, 12. A surface area extending device in the form of a zig-zag partition 20 is disposed within the tube.

One end region 13 of the tube has a double wall, the double wall comprising an outer all which is an extension of a first of the long walls 11 and an inner wall 17 which is an extension of the opposing second long wall 12.

The outer wall 16 is generally mirror-symmetrical to the wall of the opposing end portion 14.

Figure 3:
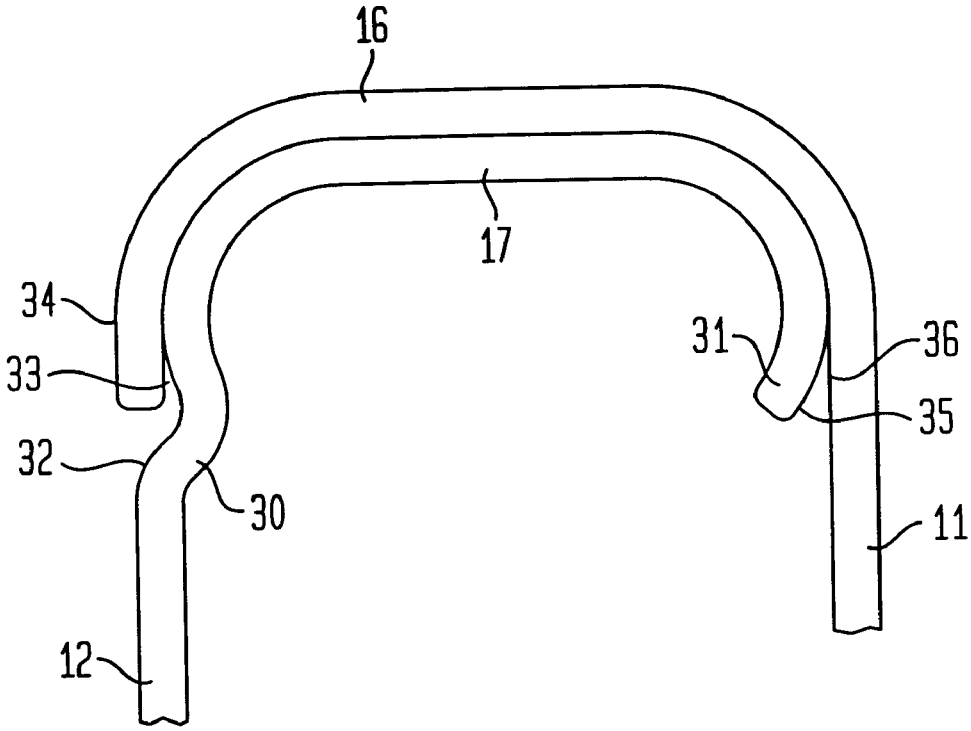
FIG. 3 shows an enlarged partial cross-section of the tube of FIG. 2

As will most clearly be seen in FIG. 3 the second long wall 12 extends via a transition region 30 into the inner wall 17, which closely conforms to the inner contour of the outer wall 16. However, the inner wall 17 continues to an extreme region 31 where inner wall 17 curves inwardly away from the outer wall 11, 16. As can clearly be seen in FIG. 3, in this embodiment an extremity region 51 deviates from the first long wall 11.

The transition region 30 deviates from the line of the second long wall 12 to accommodate the extremity region 31 of the outer wall 16 so as to conform with the overall tube envelope. The outer surface 32 of the transition region 30 is somewhat spaced from the inner surface 33 of the outer wall 16 in the region immediately adjacent the extremity region 34 of the outer wall 16 so as to afford space for flux to pass between the walls.

The extremity region 31 of the inner wall has an outer surface 35 which is spaced from the inner surface of the second long wall 11, again so as to provide a path for flux penetration to ensure brazing.

Figure 4:
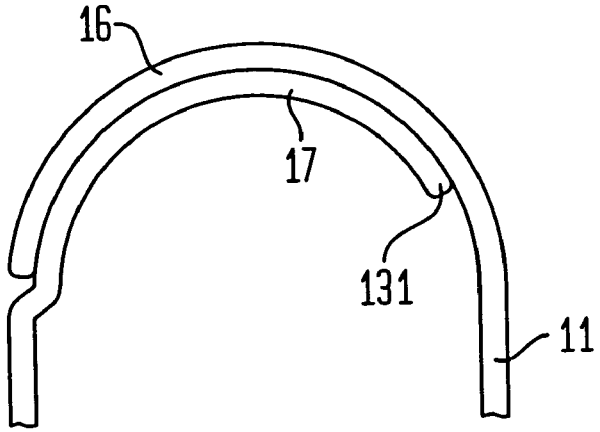
FIG. 4 shows an enlarged partial cross-section of a second preferred embodiment of the invention.

FIG. 4 shows a second embodiment of the invention, having no planar portion in the end regions and here it will be seen that the extremity 131 of the inner wall 17 deviates away from the outer wall 16 in a region where the outer wall 16 is still curving round towards the first long wall 11.

The tube can be formed by a folding machine with the extremity region 31, 131 formed at the first stations on the edge of the coil stock.

The tube thus formed is especially suitable for the NOCOLOK brazing technique for alloy radiators. However, other brazing techniques well known to one skilled in the art of the invention may be utilized.

What is claimed is:

1. A method of forming a tube for a heat exchanger, the tube having a cross-section having two opposing ends and two opposing sides, one of said ends having a double wall, said method comprising:

forming an inner wall of said double wall, said inner wall extending in one direction to a first extremity region, said inner wall extending in a second direction opposite said one direction to one of said opposing sides via a transition region;

forming an outer wall of said double wall, said outer wall extending in said one direction to the other of said opposing sides, said outer wall extending in said second direction to a second extremity region;

wherein said transition region accommodates said second extremity region and said first extremity region deviates away from said outer wall.

2. The method of claim 1, further comprising flux to penetrate between said first extremity region and said outer wall and between said second extremity region and said transition region.

3. The method of claim 2, further comprising brazing said inner wall and said outer wall together.

4. The method of claim 3, wherein said brazing step comprises NOCOLOK (RTM) brazing.

5. A tube for a heat exchanger, the tube formed from a single sheet of material, the tube having a cross-section comprising two opposed side walls and two opposed ends, said opposed ends having curved portions, the outer surface of said ends being substantially mirror symmetrical, one of said ends having a double wall comprising an inner wall and an outer wall, one of said side walls extending to form the outer wall and the other of said side walls extending to form the inner wall, wherein each of the outer wall and the inner wall has a respective extremity, the inner wall offset inwardly proximate a region overlaid by the extremity of the outer wall to accommodate the extremity of the outer wall and to provide spacing between the inner wall and the outer wall, the extremity of the inner wall deviating away from the outer wall and providing spacing between the inner wall and the outer wall proximate the extremity of the inner wall.

6. The tube of claim 5 further comprising brazed joints extending between portions of said inner wall and said outer wall.

7. The tube of claim 6, wherein said opposed ends each comprise a substantially planar portion whereby the tube is oblong in cross-section.

8. The tube of claim 7, wherein said side walls are substantially parallel.

9. The tube formed according to the method of claim 1.

10. A vehicle engine comprising the tube of claim 5.

11. A method of forming a tube from a single sheet of material, the tube characterized by a cross-section having a single-walled end, a double-walled end, a first side and a second side, said method comprising:

forming an inner wall of said double wall, said inner wall extending from said first side via a transition region, said inner wall further extending to an inner-wall extremity region;

forming an outer wall of said double wall, said outer wall extending from said second side, said outer wall further extending to an outer-wall extremity region;

wherein said transition region accommodates said outer-wall extremity region and provides spacing between the inner wall and the outer wall proximate said outer-wall extremity region, and wherein said inner-wall extremity region deviates away from said outer wall of said double wall to provide spacing between the inner wall and the outer wall proximate said inner-wall extremity region.

12. The method of claim 11, further comprising forming said single walled-end, said single walled-end extending from said first side and from said second side and linking said first side and said second side.

13. The method of claim 11, further comprising connecting said inner wall of said double wall and said outer wall of said double wall.

14. The method of claim 11, further comprising causing flux to penetrate between said inner wall of said double wall and said outer wall of said double wall.

15. The method of claim 11, further comprising causing flux to penetrate between said inner-wall extremity region and said outer wall of said double wall and between said outer-wall extremity region and said transition region.

16. The method of claim 15, further comprising brazing said inner wall of said double wall and said outer wall of said double wall.

17. The method of claim 16 wherein the step of brazing comprises NOCOLOK (RTM) brazing.

18. The method of claim 11 wherein said inner wall of said double wall and said outer wall of said double wall are substantially symmetrical.

19. The method of claim 11, said single-walled end and said double-wall end having outer surfaces, wherein said outer surface of said single-walled end and said outer surfaces of said double-wall end are substantially mirror symmetrical.

20. The method of claim 11, said first side and said second side having outer surfaces, wherein said outer surface of said first side and said outer surface of said second side are substantially mirror symmetrical.

21. A method of forming a tube for a heat exchanger, the tube characterized by a cross-section having two opposing ends and two opposing sides, one of said ends having a double wall, said method comprising:

forming an inner wall of said double wall, said inner wall extending in a first direction to a first extremity region, said inner wall extending in a second direction to one of said opposing sides via a transition region offset in said one of said opposing sides;

forming an outer wall of said double wall, said outer wall extending in said first direction to the other of said opposing sides, said outer wall extending in said second direction to a second extremity region;

wherein said transition region accommodates said second extremity region and said first extremity region deviates away from said outer wall.

22. The method of claim 21, further comprising forming the other of said ends, the other of said ends extending from and connecting said opposing sides.

23. The method of claim 21, further comprising causing flux to penetrate between said first extremity region and said outer wall and between said second extremity region and said transition region.

24. The method of claim 23, further comprising brazing said inner wall and said outer wall.

25. The method of claim 24 wherein the step of brazing comprises NOCOLOK (RTM) brazing.

26. A tube for a heat exchanger, the tube formed from a single sheet of material and having a cross-section comprising:

two opposed ends, one of said ends having a double wall comprising an inner wall and an outer wall, said inner wall and said outer wall each having a respective extremity;

a first side wall opposed a second side wall, said first side wall extending to form said outer wall and said second side wall extending to form said inner wall, wherein the contour of a region of the inner wall is offset inwardly to accommodate said extremity of said outer wall and to provide spacing between said inner wall and said outer wall proximate said extremity of said outer wall, and said extremity of said inner wall deviates from the contour of said outer wall to provide spacing between said inner wall and said outer wall proximate said extremity of said inner wall.

27. The tube of claim 26 further comprising brazed joints extending between portions of said inner wall and said outer wall.

28. The tube of claim 26, wherein each of said opposed ends, said first side wall and said second side wall comprise a substantially planar portion such that the tube is oblong in cross-section.

29. The tube of claim 26, each of said opposed ends having an outer surface, wherein said outer surface of said opposed ends are substantially mirror symmetrical.

30. The tube of claim 26, each of said first side wall and said second side wall having an outer surface, wherein said outer surface of said first side wall and said second side wall are substantially mirror symmetrical.

31. The tube of claim 26 wherein said inner wall and said outer wall of said double wall are substantially symmetrical.

* * * * *

UNITED STATES PATENT AND TRADEMARK OFFICE

CERTIFICATE OF CORRECTION

PATENT NO. : 6,192,977 B1
DATED : February 27, 2001
INVENTOR(S) : La Voyce Dey; Laszlo Valaszkai It is certified that error appears in the above-identified patent and that said Letters Patent is hereby corrected as shown below:

Title page, item [73],
Replace Assignee, Valeo Thermique Moteur, la Verriere (FR) with Valeo, Inc., Auburn Hills, MI (USA)

Signed and Sealed this

Thirtieth Day of October, 2001

*Attest:*

Nicholas P. Godici

NICHOLAS P. GODICI
*Acting Director of the United States Patent and Trademark Office*

*Attesting Officer*